US010993006B2

(12) United States Patent
Minoda

(10) Patent No.: US 10,993,006 B2
(45) Date of Patent: Apr. 27, 2021

(54) WEARABLE SPEAKER SYSTEM

(71) Applicant: SHARP KABUSHIKI KAISHA, Sakai (JP)

(72) Inventor: Hidenori Minoda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 53 days.

(21) Appl. No.: 16/492,016

(22) PCT Filed: Jan. 29, 2018

(86) PCT No.: PCT/JP2018/002701
§ 371 (c)(1),
(2) Date: Nov. 20, 2019

(87) PCT Pub. No.: WO2018/163654
PCT Pub. Date: Sep. 13, 2018

(65) Prior Publication Data

US 2020/0100004 A1 Mar. 26, 2020

(30) Foreign Application Priority Data

Mar. 8, 2017 (JP) ..... JP2017-043604

(51) Int. Cl.
*H04R 5/033* (2006.01)
*H04R 1/02* (2006.01)
*H04R 1/22* (2006.01)

(52) U.S. Cl.
CPC ..... *H04R 1/025* (2013.01); *H04R 1/22* (2013.01); *H04R 5/0335* (2013.01)

(58) Field of Classification Search
CPC ..... H04R 1/025; H04R 1/026; H04R 1/105; H04R 1/1091; H04R 5/02; H04R 5/023;
(Continued)

(56) References Cited

U.S. PATENT DOCUMENTS 10,582,301 B2 * 3/2020 Hatta ..... H04R 1/10
2016/0021446 A1 1/2016 Litovsky et al.

FOREIGN PATENT DOCUMENTS

CN 102300139 A 12/2011
JP H08-511151 A 11/1996
(Continued)

OTHER PUBLICATIONS

Elements of Acoustical Engineering, by H. F. Olson, 1940, pp. 130-132, Chapter 7.11 (Year: 1940).*

*Primary Examiner* — Kile O Blair
(74) *Attorney, Agent, or Firm* — ScienBiziP, P.C.

(57) ABSTRACT

To provide a wearable speaker system that can obtain a higher sense of presence through reproduction of bass. A wearable speaker system includes an extendable bellows tube including a first end and a second end; a first speaker unit which is connected to the first end and of which an inside communicates with an inside of the bellows tube; a second speaker unit which is connected to the second end and of which an inside communicates with the inside of the bellows tube; a first bass reflex duct having one end that is open to an outside in the first speaker unit and the other end that is open to the inside of the bellows tube; and a second bass reflex duct having one end that is open to the outside in the second speaker unit and the other end that is open to the inside of the bellows tube.

6 Claims, 4 Drawing Sheets

(58) Field of Classification Search
CPC .. H04R 5/033; H04R 5/0335; H04R 2201/02; H04R 2201/023; H04R 2201/10; H04R 1/2815; H04R 1/2819; H04R 1/2823; H04R 1/2826
See application file for complete search history.

(56) References Cited

FOREIGN PATENT DOCUMENTS

| | | | | | |
|---|---|---|---|---|---|
| JP | 2008-263374 | A | | 10/2008 | |
| JP | 2008263374 | A | * | 10/2008 | |
| JP | 2009-201088 | A | | 9/2009 | |
| WO | 95/34184 | A1 | | 12/1995 | |
| WO | 2016/039245 | A1 | | 3/2016 | |
| WO | WO-2016039245 | A1 | * | 3/2016 | ..... H04R 5/02 |

* cited by examiner

WEARABLE SPEAKER SYSTEM

TECHNICAL FIELD

The present invention relates to a wearable speaker system, and more particularly to a wearable speaker system that is used by a listener worn on a portion other than the ears.

BACKGROUND ART

As a speaker system that outputs sound, for example, there is one built in a television receiver or the like. However, a speaker of the built-in speaker system does not have a large caliber and cannot obtain a large volume, and bass cannot be reproduced sufficiently, resulting in lack of a sense of presence. In order to obtain the sense of presence, a speaker system and headphones having a large caliber speaker are often used.

In a case in which a speaker system having a large caliber speaker is used, a certain amount of space is required, which is not suitable for enjoying music or the like while moving. When the headphones are used, music or the like can be enjoyed while moving, but there is a problem that a listener using the headphones cannot hear surrounding sound. In the case of the headphones, a sound image is localized in the head of the listener, so that there is a problem of feeling tired when the headphones are used for a long time.

In order to solve the above problems, PTLs 1 to 4 disclose a wearable speaker system that is worn on the body of a listener and does not block the ear of the listener.

PTL 1 discloses a neck-hanging type wearable speaker device, in which a speaker is positioned below the chin of the listener and faces the ear. PTLs 2 and 3 disclose a wearable speaker device in which speakers are provided on both sides of a neck hanging portion, a right ear speaker is positioned on a right shoulder, and a left ear speaker is positioned on a left shoulder.

PTL 4 discloses an annular neck-hanging type wearable speaker device, which includes a passive radiator or a bass reflex port in addition to the speaker, and is capable of reproducing bass and can give the listener the sense of presence unlike PTLs 1 to 3.

CITATION LISTS

Patent Literatures

PTL 1: Japanese Unexamined Patent Application Publication No. 2009-201088

PTL 2: Japanese Unexamined Patent Application Publication No. 2008-263374

PTL 3: Japanese Unexamined Patent Application Publication (Translation of PCT Application) No. 8-511151

PTL 4: International Publication No. 2016/039245

SUMMARY OF INVENTION

Technical Problem

As described above, the wearable speaker system described in PTLs 1 to 3 does not include a mechanism related to reproduction of bass. In the wearable speaker device disclosed in PTL 4, the speaker, the passive radiator, and the bass reflex port are separated from each other, so that the reproduction of the bass may not be sufficiently performed and the sense of presence may be insufficient.

The present invention has been made in view of the above circumstances, and an object of the present invention is to provide a wearable speaker system that can provide a high sense of presence through reproduction of bass.

Solution to Problem

In order to solve the problem, a wearable speaker system according to first technical means of the present invention includes: an extendable bellows tube including a first end and a second end; a first speaker unit which is connected to the first end and of which an inside communicates with an inside of the bellows tube; a second speaker unit which is connected to the second end and of which an inside communicates with the inside of the bellows tube; a first bass reflex duct having one end that is open to an outside in the first speaker unit and the other end that is open to the inside of the bellows tube; and a second bass reflex duct having one end that is open to the outside in the second speaker unit and the other end that is open to the inside of the bellows tube.

According to the wearable speaker system of second technical means of the present invention, in the first technical means, the bellows tube has a removable weight body.

According to the wearable speaker system of third technical means of the present invention, in the first or second technical means, the first bass reflex duct and the second bass reflex duct intersect with each other inside the bellows tube.

According to the wearable speaker system of fourth technical means of the present invention, in any one of the first to third technical means, when the bellows tube is hung on a neck of a listener, one end of each of the first bass reflex duct and the second bass reflex duct is positioned below an ear of the listener.

According to the wearable speaker system of fifth technical means of the present invention, in any one of the first to fourth technical means, when the bellows tube is hung on a neck of a listener, the first speaker unit and the second speaker unit are positioned on an upper chest of the listener.

According to the wearable speaker system of sixth technical means of the present invention, in the fourth or fifth technical means, the wearable speaker system further includes a cushioning member or a neckband between the bellows tube and a body of the listener.

Advantageous Effects of Invention

According to the present invention, it is possible to provide a wearable speaker system that can obtain a higher sense of presence through reproduction of bass.

DESCRIPTION OF EMBODIMENTS

Figure 1:
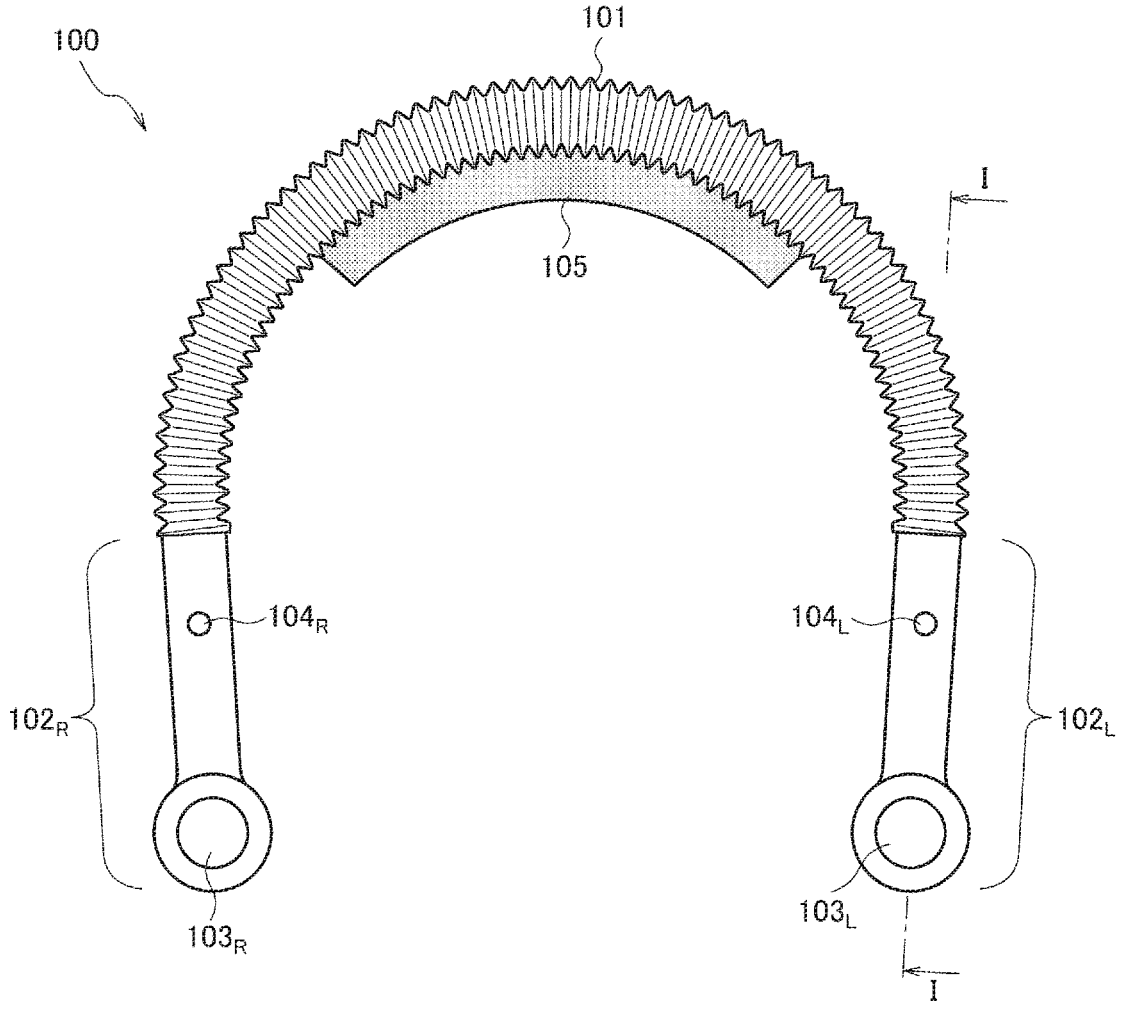
FIG. 1 is a front view of a wearable speaker system according to Embodiment 1 of the present invention.

Hereinafter, preferred embodiments of a wearable speaker system of the present invention will be described with reference to the drawings. In the following description, the same reference numerals are assumed to be the same configurations and the description thereof may be omitted. Moreover, although a plurality of embodiments are described, as long as a combination is possible, an embodiment can be implemented in arbitrary combinations.

Embodiment 1

Figure 2:
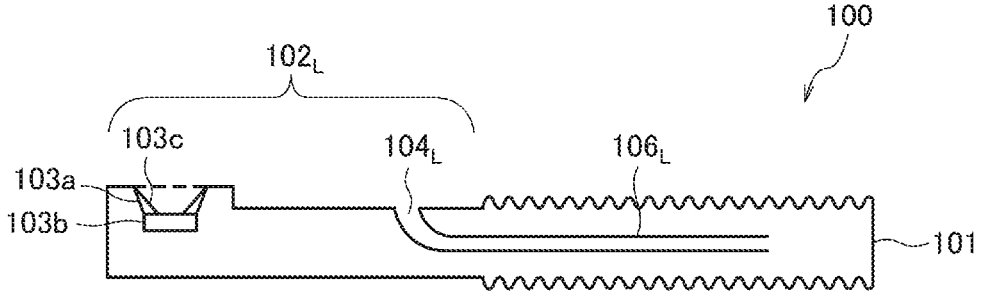
FIG. 2 is a sectional view of the wearable speaker system according to Embodiment 1 of the present invention.
Figure 4:
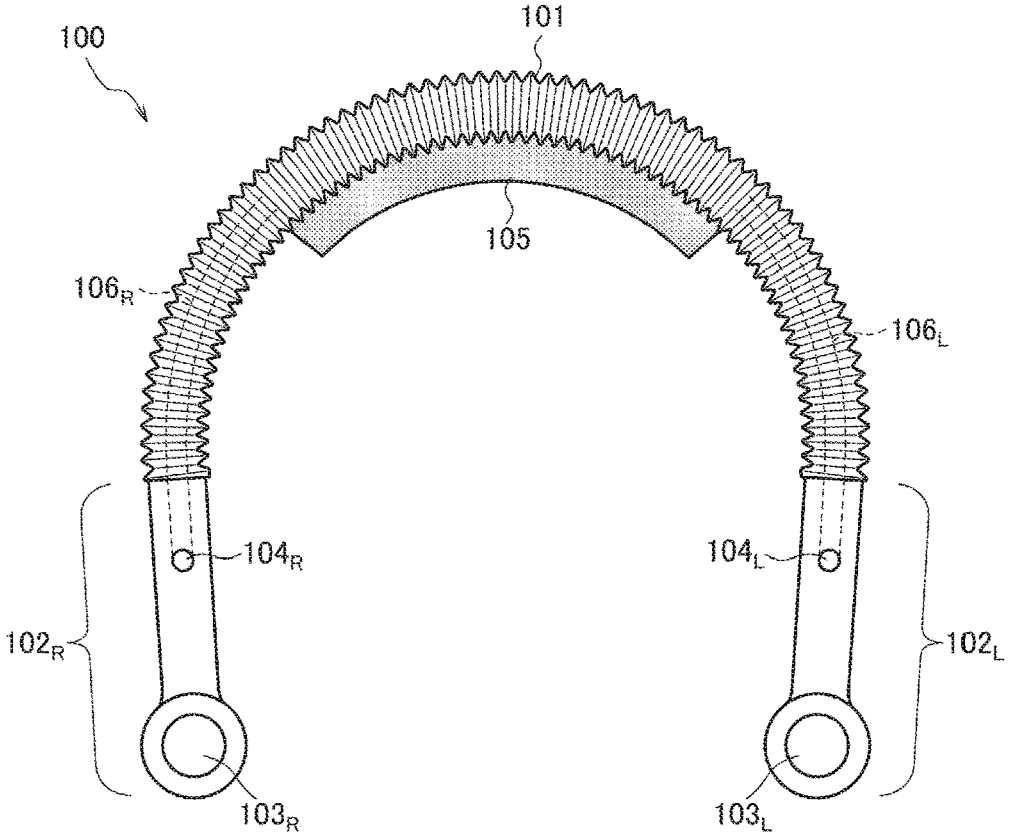
FIG. 4 is a front perspective view of a wearable speaker system according to Embodiment 2 of the present invention.
Figure 5:
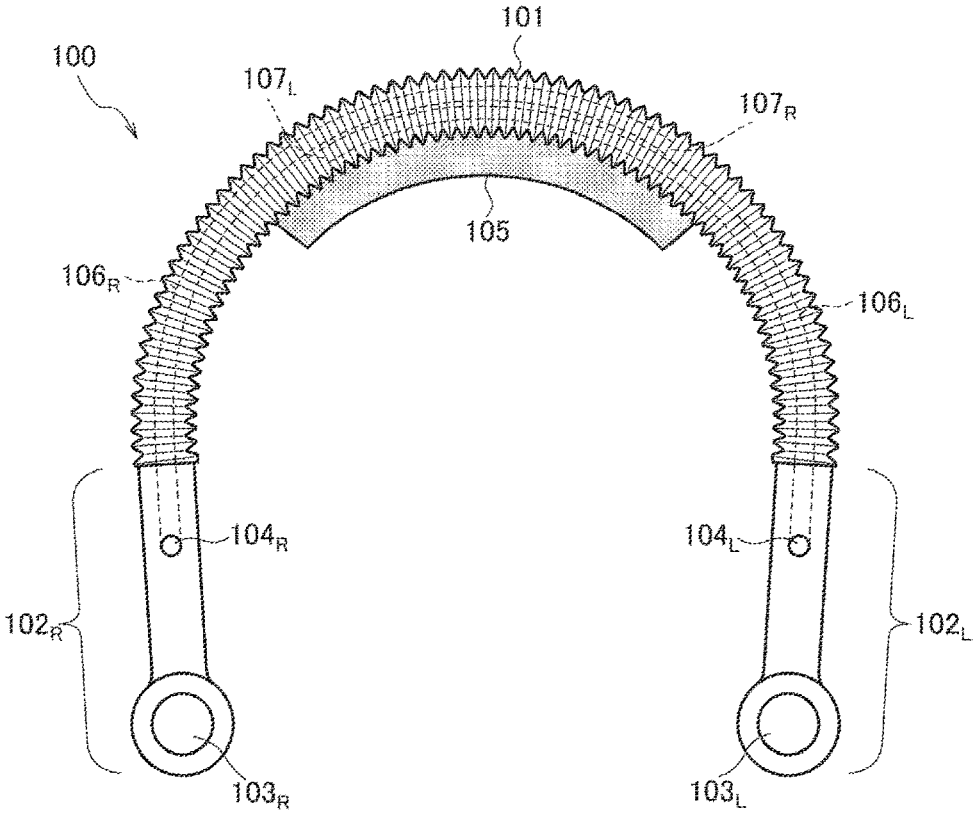
FIG. 5 is a front perspective view of the wearable speaker system according to Embodiment 2 of the present invention.

FIG. 1 is a front view of a wearable speaker system 100 according to Embodiment 1. The wearable speaker system 100 includes a bellows tube 101, a first speaker unit $\mathbf{102}_L$, a second speaker unit $\mathbf{102}_R$, a first bass reflex duct $\mathbf{106}_L$, and a second bass reflex duct $\mathbf{106}_R$. The wearable speaker system 100 may further include a cushioning member 105. The first bass reflex duct $\mathbf{106}_L$ is illustrated in FIGS. 2, 4 and 5, and the second bass reflex duct $\mathbf{106}_R$ is illustrated in FIGS. 4 and 5.

The bellows tube 101 is a bellows-like tube, and a side surface is repeatedly formed with valley folds and mountain folds. Since valley folds and mountain folds are repeatedly formed on the side surface, the bellows tube 101 can be extended and contracted. The bellows tube 101 has a first end and a second end that form openings (not illustrated), and the first end and the second end communicate with each other inside the bellows tube 101.

The first speaker unit $\mathbf{102}_L$ has an elongated shape having a cavity inside. At an end of the elongated shape, a first speaker $\mathbf{103}_L$ is provided that is oriented in a direction perpendicular to a direction in which the elongated shape extends. The other end of the elongated shape has an opening (not illustrated), and the opening is connected to the first end of the bellows tube 101. Since the opening of the first speaker unit $\mathbf{102}_L$ is connected to the first end of the bellows tube 101, the inside of the bellow's tube 101 and the inside of the first speaker unit $\mathbf{102}_L$ communicate with each other. Therefore, movement of air is possible between the first speaker unit $\mathbf{102}_L$ and the bellow's tube 101. In addition, the first speaker unit $\mathbf{102}_L$ has a first opening portion $\mathbf{104}_L$. In FIG. 1, the first speaker $\mathbf{103}_L$ and the first opening portion $\mathbf{104}_L$ face the same direction, but may face different directions. As described with reference to FIG. 2, one end of the first bass reflex duct $\mathbf{106}_L$ is connected to the first opening portion $\mathbf{104}_L$.

The second speaker unit $\mathbf{102}_R$ has a cavity inside and has an elongated shape having the same length as that of the first speaker unit $\mathbf{102}_L$. At the end of the elongated shape, a second speaker $\mathbf{103}_R$ is provided that is oriented in a direction perpendicular to the direction in which the elongated shape extends. In addition, the other end of the elongated shape has an opening (not illustrated) and is connected to the second end of the bellows tube 101. Since the opening of the second speaker unit $\mathbf{102}_R$ is connected to the second end of the bellows tube 101, the inside of the bellows tube 101 and the inside of the second speaker unit $\mathbf{102}_R$ communicate with each other. Therefore, the movement of air is possible between the second speaker unit $\mathbf{102}_R$ and the bellows tube 101. Further, the second speaker unit $\mathbf{102}_R$ has a second opening portion $\mathbf{104}_R$. In FIG. 1, the second speaker $\mathbf{103}_R$ and the second opening portion $\mathbf{104}_R$ face the same direction, but may face different directions. As described with reference to FIG. 2, one end of the second bass reflex duct $\mathbf{106}_R$ is connected to the second opening portion $\mathbf{104}_R$.

The cushioning member 105 is provided on a side surface of the bellows tube 101. The cushioning member 105 is disposed at a center portion of the bellows tube 101, more strictly, a region including a position where the number of mountain folds and valley folds of the bellows tube 101 from the first end and the second end is the same. The cushioning member 105 is formed of an easily extendable material such as foamed polyurethane or rubber, and attenuates the vibration of the bellows tube 101. The vibration can be transmitted to a side opposite to the cushioning member 105 where the bellows tube 101 is provided. As a material for forming the cushioning member 105, in addition to a resin-based material such as foamed polyurethane or rubber, a mechanically extendable spring, an airtight bag filled with air, or the like can be used.

FIG. 2 is a sectional view in a middle from a tip of the first speaker unit $\mathbf{102}_L$ to the center portion of the bellows tube 101 in a sectional view taken along line I-I in FIG. 1. FIG. 2 illustrates a cross section of the first speaker unit $\mathbf{102}_L$ including the first opening portion $\mathbf{104}_L$ and a cross section of a part of the bellows tube 101. A sectional view in a middle from a tip of the second speaker unit $\mathbf{102}_R$ to the center portion of the bellows tube 101 can also be easily obtained by reversing the left and right of FIG. 2, and changing reference numerals appropriately.

The first speaker unit $\mathbf{102}_L$ includes a first speaker $\mathbf{103}_L$ oriented upward to FIG. 2 and a first opening portion $\mathbf{104}_L$ oriented upward to FIG. 2 in the same manner as the first speaker $\mathbf{103}_L$. One end of the first bass reflex duct $\mathbf{106}_L$ is connected to the first opening portion $\mathbf{104}_L$, and one end of the first bass reflex duct $\mathbf{106}_L$ is open to the outside of the wearable speaker system 100. Similar to the relationship between the first opening portion $\mathbf{104}_L$ and the first bass reflex duct $\mathbf{106}_L$, the second bass reflex duct $\mathbf{106}_R$ is also connected to one end of the second opening portion $\mathbf{104}_R$, and one end of the second bass reflex duct $\mathbf{106}_R$ is open to the outside of the wearable speaker system 100.

The first speaker $\mathbf{103}_L$ includes a frame 103*a* forming the first speaker $\mathbf{103}_L$, a magnetic circuit 103*b* supported by the frame 103*a*, and a diaphragm 103*c* connected to the magnetic circuit 103*b* and the frame 103*a*. The magnetic circuit 103*b* includes a magnet and a voice coil (not illustrated). The voice coil is connected to a cable (not illustrated), and vibrates the diaphragm 103*c* according to a signal supplied to the cable to generate sound.

As described above, since the inside of the bellows tube 101 and the inside of the first speaker unit $\mathbf{102}_L$ communicate with each other, when the diaphragm 103*c* of the first speaker $\mathbf{103}_L$ vibrates due to the action of the magnet and the voice coil to generate the sound, a change in the atmospheric pressure inside the first speaker unit $\mathbf{102}_L$ is transmitted to the inside of the bellows tube 101 according to the sound. Therefore, the bellows tube 101 also vibrates according to the sound. Normally, the bellows tube 101 is larger in size and heavier in weight than those of the diaphragm 103*c*, so that the bellows tube 101 vibrates mainly according to a magnitude of a low frequency component of the sound generated by the diaphragm 103*c*.

In addition, one end of the first bass reflex duct $\mathbf{106}_L$ is connected to the first opening portion $\mathbf{104}_L$, and the other end of the first bass reflex duct $\mathbf{106}_L$ is open to the inside the bellows tube 101. Therefore, when the change in the atmospheric pressure inside the first speaker unit $\mathbf{102}_L$ is transmitted to the inside of the bellows tube 101, the change in the atmospheric pressure is transmitted from the other end of the first bass reflex duct $\mathbf{106}_L$ to the inside, and entering and exiting of the air to and from the first opening portion $\mathbf{104}_L$ generate. Characteristics of the change in the atmospheric pressure transmitted to the first bass reflex duct $\mathbf{106}_L$ vary depending on a diameter and a length of the first bass reflex duct $\mathbf{106}_L$, but a high frequency component of the change in the atmospheric pressure inside the first speaker unit $\mathbf{102}_L$ generated by the diaphragm 103*c* is transmitted to the inside of the bellows tube 101 while being attenuated more than a low frequency component thereof. Therefore, the change in the atmospheric pressure transmitted to the first bass reflex duct $\mathbf{106}_L$ mainly corresponds to the magnitude of the low frequency component of the sound generated by the diaphragm 103*c*. Therefore, in the first opening portion $\mathbf{104}_L$, entering and exiting of the air mainly according to the low frequency component of the sound generated by the diaphragm 103*c* generate, and the sound is generated by the entering and exiting of the air.

Figure 3:
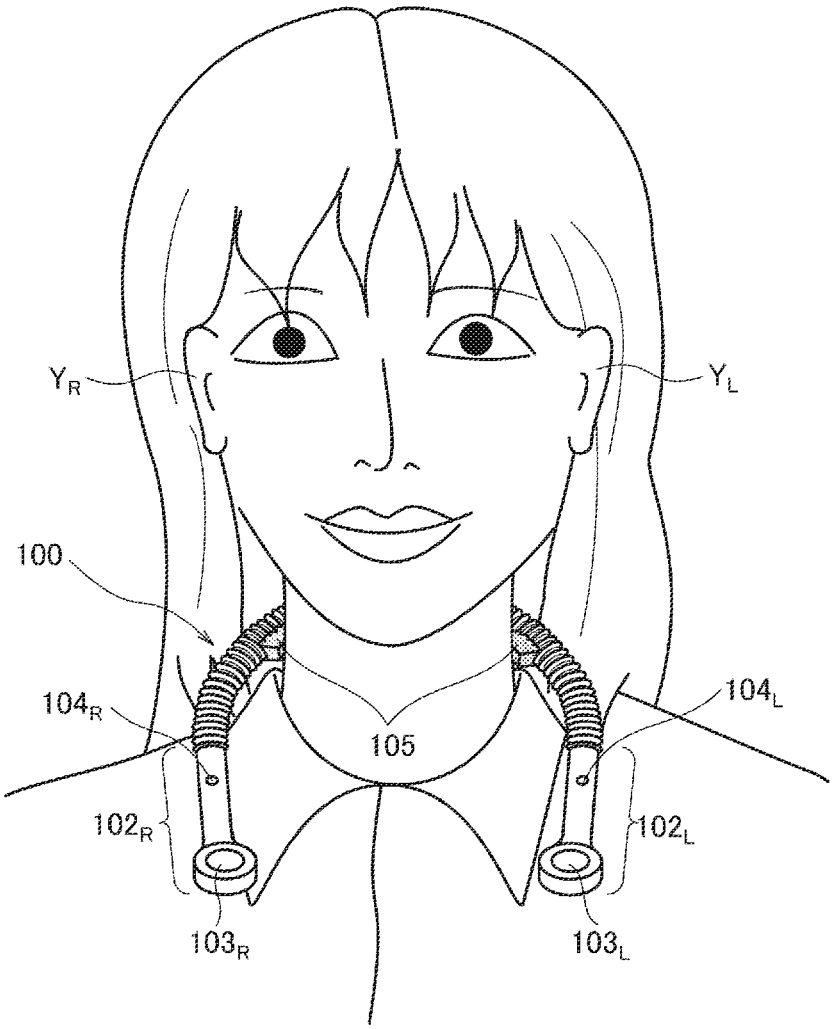
FIG. 3 is a view for explaining the wearable speaker system according to Embodiment 1 of the present invention.

FIG. 3 is a view illustrating a state (state being hung on the neck) in which the wearable speaker system 100 is hung from behind the neck of the listener so that the center portion of the bellows tube 101 is positioned behind the neck, the bellows tube 101 surrounds the neck, and the first speaker unit $\mathbf{102}_L$ and the second speaker unit $\mathbf{102}_R$ are positioned in the front of the neck. In FIG. 3, the cushioning member 105 is disposed between the bellows tube 101 and the neck of the listener.

When the sound is generated from the first speaker $\mathbf{103}_L$ and the second speaker $\mathbf{103}_R$ in the state of being hung on the neck, as described above, the bellows tube 101 vibrates mainly according to the magnitude of the low frequency component of the sound generated by the diaphragm 103*c*. In the state of being hung on the neck, the bellows tube 101 is disposed so as to surround the neck, so that vibration and sound of mainly low frequency component generated by the bellows tube 101 are emitted from the bellows tube 101 surrounding the listener, and the listener can obtain a high sense of presence. Further, in the state of being hung on the neck, the first speaker unit $\mathbf{102}_L$ and the second speaker unit $\mathbf{102}_R$ are positioned in the upper chest of the listener, for example, in a periphery of the clavicle or an upper portion of the breast. Therefore, the vibration of the first speaker unit $\mathbf{102}_L$ and the second speaker unit $\mathbf{102}_R$ can also be felt, and the sense of presence can be obtained in front of the body of the listener.

Since the bellows tube 101 can be extended and contracted, in order to position the first speaker unit $\mathbf{102}_L$ and the second speaker unit $\mathbf{102}_R$ on the upper chest portion of the listener, it is necessary to set a distance between the first speaker unit $\mathbf{102}_L$ and the second speaker unit $\mathbf{102}_R$ via the bellows tube 101. Therefore, for example, a cable connecting the first speaker unit $\mathbf{102}_L$ and the second speaker unit $\mathbf{102}_R$ may be put inside the bellows tube 101 to fix an upper limit of the distance, or the bellows tube 101 may be supported by a U-shaped support member, and the shape and length of the bellows tube 101 may be fixed. Further, when the cushioning member 105 is disposed, the rigidity of the cushioning member 105 is increased so that the U-shape can be maintained, and the cushioning member 105 is provided on a side surface of the bellows tube 101 longer than that illustrated in FIG. 1, and variations in the length and shape of the bellows tube 101 can be reduced.

In the first opening portion $\mathbf{104}_L$, the entering and exiting of the air are generated, mainly according to the low frequency component of the sound generated by the diaphragm 103*c* of the first speaker $\mathbf{103}_L$, and the bass is transmitted to the listener by the entering and exiting of the air. Similarly, the bass is transmitted to the listener due to the entering and exiting of the air from the second opening portion $\mathbf{104}_R$. Therefore, the first opening portion $\mathbf{104}_L$ and the second opening portion $\mathbf{104}_R$ allow the listener to obtain a high sense of presence. In order to obtain a higher sense of presence with the first opening portion $\mathbf{104}_L$ and the second opening portion $\mathbf{104}_R$, it is preferable that each of the first opening portion $\mathbf{104}_L$ and the second opening portion $\mathbf{104}_R$ is positioned below left and right ears $Y_L$ and $Y_R$ of the listener.

Since the inside of the bellows tube 101 and the inside of the first speaker unit $\mathbf{102}_L$ communicate with each other, the change in the atmospheric pressure according to the sound generated by the first speaker $\mathbf{103}_L$ is also transmitted to the second speaker unit $\mathbf{102}_R$ side via the bellows tube 101. In addition, since the inside of the bellows tube 101 and the inside of the second speaker unit $\mathbf{102}_R$ also communicate with each other, the change in the atmospheric pressure according to the sound generated by the second speaker $\mathbf{103}_R$ is also transmitted to the first speaker unit $\mathbf{102}_L$ side via the bellows tube 101, and the diaphragms 103*c* of the first speaker unit $\mathbf{102}_L$ and the first speaker $\mathbf{103}_L$ vibrate. Therefore, the left ear $Y_L$ of the listener hears not only the sound from the first speaker $\mathbf{103}_L$ but also sound obtained by mixing, to some extent, the sound generated from the second speaker $\mathbf{103}_R$ due to the vibration of the first speaker unit $\mathbf{102}_L$ by the change in the atmospheric pressure, or the vibration of the diaphragm 103*c* of the first speaker $\mathbf{103}_L$. The right ear $Y_R$ hears not only the sound from the second speaker $\mathbf{103}_R$ but also sound obtained by mixing, to some extent, the sound generated from the first speaker $\mathbf{103}_L$. Therefore, the listener feels that a localization position of a sound image is positioned forward from the head, and can obtain a higher sense of presence.

As described above, according to the present embodiment, by the bellows tube 101 communicated with the insides of the first speaker unit $\mathbf{102}_L$ and the second speaker unit $\mathbf{102}_R$, the first bass reflex duct $\mathbf{106}_L$, and the second bass reflex duct $\mathbf{106}_R$, the bass can be reproduced, and the listener can obtain a higher sense of presence.

Further, unlike the headphones, the ears of the listener are not blocked. Therefore, since the sound image is not localized in the head of the listener, there is little feeling of fatigue. In addition, the listener can hear surrounding sounds, so that attention can be paid to the surroundings in order to avoid dangers. Moreover, the wearable speaker system 100 is in a state of being hung on the neck, the first speaker $\mathbf{103}_L$, the second speaker $\mathbf{103}_R$, and the like are disposed at positions close to the ears. Therefore, a sound field does not change even when the listener moves, and a sufficient sound pressure can be obtained even at a low volume.

A use scene of the wearable speaker system 100 of the present embodiment as described above includes a scene of listening to music or the like in combination with a music playback device, a smartphone, or a tablet-type terminal, or watching, with sound, a video displayed on a screen of the smartphone or the tablet terminal. In addition, by the wearable speaker system 100, it is also possible to reproduce TV sound that is difficult to hear due to a decline in hearing ability in the ears of elderly people or the like. In addition, it is possible to obtain a high sense of presence through vision and hearing by being combined with a virtual reality or augmented reality system.

Embodiment 2

FIGS. 4 and 5 are front perspective views of a wearable speaker system 100 according to Embodiment 2 of the present invention as respectively viewed from the front.

FIG. 4 is a view illustrating, by dotted lines, a first bass reflex duct $\mathbf{106}_L$ and a second bass reflex duct $\mathbf{106}_R$, each one end of which is connected to each of a first opening portion $\mathbf{104}_L$ and a second opening portion $\mathbf{104}_R$. Lengths of the first bass reflex duct $\mathbf{106}_L$ and the second bass reflex duct $\mathbf{106}_R$ can be arbitrarily selected depending on which range of a bass portion of a frequency band of the sound generated from a first speaker $\mathbf{103}_L$ and a second speaker $\mathbf{103}_R$ is to be emphasized. When the lengths of the first bass reflex duct $\mathbf{106}_L$ and the second bass reflex duct $\mathbf{106}_R$ are further increased, the other ends of the first bass reflex duct $\mathbf{106}_L$ and the second bass reflex duct $\mathbf{106}_R$ are separated from the first speaker $\mathbf{103}_L$ and the second speaker $\mathbf{103}_R$. As a result, the high sound is further attenuated and transmitted to the other end of each of the first bass reflex duct $\mathbf{106}_L$ and the second bass reflex duct $\mathbf{106}_R$, so that the lower frequency range is emphasized.

Each of the first bass reflex duct $\mathbf{106}_L$ and the second bass reflex duct $\mathbf{106}_R$ is also related to the localization position of the sound image as described above. For example, as illustrated in FIG. 5, the length of each of the first bass reflex duct $\mathbf{106}_L$ and the second bass reflex duct $\mathbf{106}_R$ may be increased, and other ends $\mathbf{107}_L$ and $\mathbf{107}_R$ may be positioned beyond a center portion of a bellows tube 101. In other words, the first bass reflex duct $\mathbf{106}_L$ and the second bass reflex duct $\mathbf{106}_R$ may intersect inside the bellows tube 101.

As described above, according to the configuration of the first bass reflex duct $\mathbf{106}_L$ and the second bass reflex duct $\mathbf{106}_R$, the change in the atmospheric pressure corresponding to the sound generated by the second speaker $\mathbf{103}_R$ is guided from the other end $\mathbf{107}_L$ of the first bass reflex duct $\mathbf{106}_L$ to the first opening portion $\mathbf{104}_L$. The change in the atmospheric pressure corresponding to the sound generated by the first speaker $\mathbf{103}_L$ is guided from the other end $\mathbf{107}_R$ of the second bass reflex duct $\mathbf{106}_R$ to the second opening portion $\mathbf{104}_R$. Therefore, entering and exiting of the air corresponding to the sound mainly generated by the second speaker $\mathbf{103}_R$ are generated from the first opening portion $\mathbf{104}_L$, and entering and exiting of the air corresponding to the sound mainly generated by the first speaker $\mathbf{103}_L$ are generated from the second opening portion $\mathbf{104}_R$.

Therefore, the listener hears the sound heard on the left ear $Y_L$ by being mixed with the sound on the right side and the sound heard on the right ear $Y_R$ by being mixed with the sound on the left side. Therefore, the sound is heard as the localization position of the sound has moved forward, and it is possible to obtain a higher sense of presence.

Embodiment 3

Figure 6:
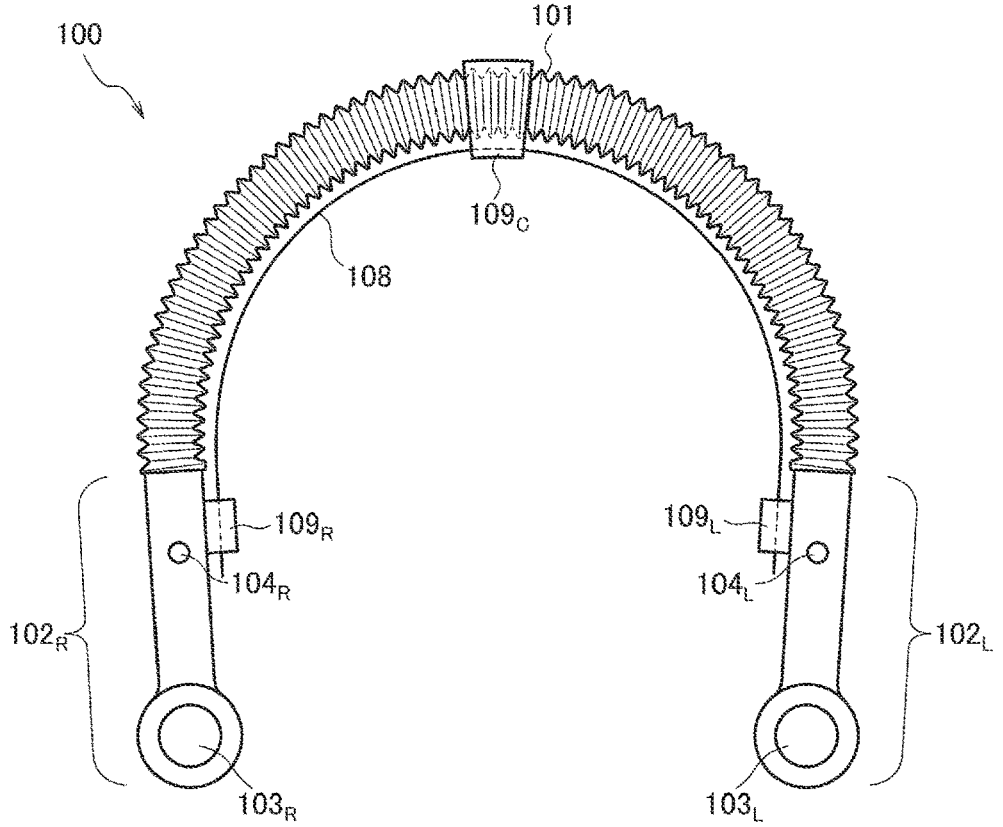
FIG. 6 is a front view of a wearable speaker system according to Embodiment 3 of the present invention.

FIG. 6 is a front view of a wearable speaker system 100 according to Embodiment 3 of the present invention.

FIG. 6 illustrates an example in which a shape and length of a bellows tube 101 are fixed using a U-shaped neckband 108. The neckband 108 is formed of, for example, a material having rigidity such as metal and maintains a U shape. In addition, a center connector $\mathbf{109}_C$ that fixes a relative positional relationship between a center portion of the bellows tube 101 and a center portion of the neckband is disposed at a center portion of the neckband 108. The center connector $\mathbf{109}_C$ has a shape in which, for example, two rings are connected, one ring grips the center portion of the bellows tube 101, and the other ring grips the center portion of the neckband 108. The center portion of the bellows tube 101 and the center portion of the neckband 108 are fixed.

A left end portion of the neckband 108 is connected to a first speaker unit $\mathbf{102}_L$ via a first connection portion $\mathbf{109}_L$, and a right end portion of the neckband 108 is connected to a second speaker unit $\mathbf{102}_R$ via a second connection portion $\mathbf{109}_R$. A relative positional relationship between the neckband 108, the first speaker unit $\mathbf{102}_L$, and the second speaker unit $\mathbf{102}_R$ is fixed. The first connection portion $\mathbf{109}_L$ and the second connection portion $\mathbf{109}_R$ have holes that are slightly larger than an outer shape of the neckband 108, and by allowing the insides of the holes and an outer periphery of the neckband 108 to slide, the length of the bellows tube 101 can be made variable according to a thickness and a physique of the neck of the listener.

The neckband 108 is positioned inside the U-shape of the U-shaped bellows tube 101 in FIG. 6, and is positioned between the body of the listener and the bellows tube 101 in the state of being hung on the neck. Therefore, it is possible to prevent that the bellows tube 101 directly comes into contact with the body of the listener and gives a discomfort feeling to the listener. In particular, when the vibration of the bellows tube 101 includes medium/high frequency components, when the bellows tube 101 directly comes into contact with the body of the listener, the listener feels uncomfortable, but the neckband 108 attenuates the frequency of the medium/high sound. Therefore, it is possible to prevent the listener from feeling uncomfortable.

The position of the neckband 108 is not limited to the inside of the U shape formed by the bellows tube 101 as illustrated in FIG. 6, and may be outside the U shape, or an upper surface side or a lower surface side of the wearable speaker system 100. Further, the neckband 108 is not a single one, and there are a plurality of neckbands 108, which may be respectively located at one or more positions on any one of the inside and the outside of the U-shape, and the upper surface side and the lower surface side of the wearable speaker system 100.

Embodiment 4

Figure 7:
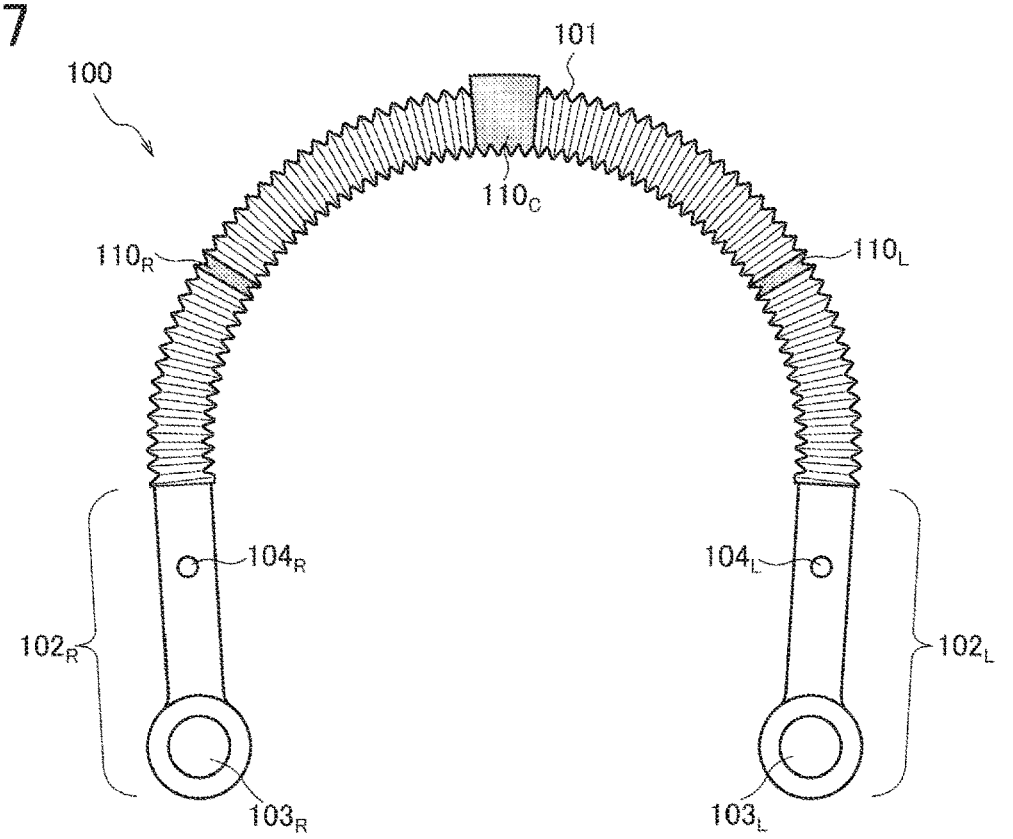
FIG. 7 is a front view of a wearable speaker system according to Embodiment 4 of the present invention.

FIG. 7 is a front view of a wearable speaker system 100 according to Embodiment 4 of the present invention.

Vibration characteristics of a bellows tube 101 depend on a length, a diameter, and material rigidity of the bellows tube 101. When a neckband 108 is used as in Embodiment 3, the vibration characteristics of the bellows tube 101 also depend on the vibration characteristics of the neckband 108. Furthermore, the vibration characteristics of the bellows tube 101 also depend on a mass and a mass distribution of the bellows tube 101. For example, if the mass of the bellows tube 101 is large, an inertial force increases, high frequency vibration is suppressed, and, for example, a resonance frequency of the vibration of the bellows tube 101 changes to a low frequency.

Therefore, in the present embodiment, the bellows tube 101 is provided with a weight body, and the mass distribution of the bellows tube 101 is changed to change the vibration characteristics. Specifically, as illustrated in FIG. 7, a weight body $\mathbf{110}_L$ is disposed on a first speaker unit $\mathbf{102}_L$ side of the bellows tube 101, and a weight body $\mathbf{110}_R$ is disposed on a second speaker unit $\mathbf{102}_R$ side thereof. Further, a weight body $\mathbf{110}_C$ can also be disposed at a center portion of the bellows tube 101.

Each of the weight bodies $\mathbf{110}_L$, $\mathbf{110}_R$, and $\mathbf{110}_C$ is made of a high-density material such as a metal, and is disposed in the bellows tube 101. Further, with respect to the weight body $\mathbf{110}_C$, the mass can be increased by disposing a driving power source and a driving circuit for driving the first speaker $\mathbf{103}_L$ and the second speaker $\mathbf{103}_R$.

There are various modes of connection between each of the weight bodies $\mathbf{110}_L$, $\mathbf{110}_R$, and $\mathbf{110}_C$, and the bellows tube 101. For example, each of the weight bodies $\mathbf{110}_L$, $\mathbf{110}_R$, and $\mathbf{110}_C$ is connected to the bellows tube 101 so as to cover an outer periphery of the bellows tube 101. In addition, an inner shape of each of the weight bodies $\mathbf{110}_L$, $\mathbf{110}_R$, and $\mathbf{110}_C$ is matched with an outer peripheral shape of the bellows tube 101. For example, the inside of each of the weight bodies $\mathbf{110}_L$, $\mathbf{110}_R$, and $\mathbf{110}_C$ can be formed in an annular shape or a shape of a Randle ring shape used in a visual acuity chart.

Further, it is preferable that each of the weight bodies $\mathbf{110}_L$, $\mathbf{110}_R$, and $\mathbf{110}_C$ can be installed and removed from the bellows tube 101. For example, each of the weight bodies $\mathbf{110}_L$, $\mathbf{110}_R$, and $\mathbf{110}_C$ is formed into a Randall ring shape by using a material having high elasticity, and a distance between the open ends of the Randall ring is increased to be installed or removed from the bellows tube 101. Thus, by making each of the weight bodies $\mathbf{110}_L$, $\mathbf{110}_R$, and $\mathbf{110}_C$ freely installable and removable to and from the bellows tube 101, the vibration characteristics of the bellows tube 101 can be set in accordance with the characteristics and genre of the sound reproduced by the wearable speaker system 100, and a high sense of presence can be provided.

The invention claimed is:

1. A wearable speaker system comprising:

an extendable bellows tube including a first end and a second end;

a first speaker unit which is connected to the first end and of which an inside communicates with an inside of the bellows tube;

a second speaker unit which is connected to the second end and of which an inside communicates with the inside of the bellows tube;

a first bass reflex duct having one end that is open to an outside in the first speaker unit and the other end that is open to the inside of the bellows tube; and a second bass reflex duct having one end that is open to the outside in the second speaker unit and the other end that is open to the inside of the bellows tube.

2. The wearable speaker system according to claim 1, wherein the bellows tube has a removable weight body.

3. The wearable speaker system according to claim 1, wherein the first bass reflex duct and the second bass reflex duct intersect with each other inside the bellows tube.

4. The wearable speaker system according to claim 1, wherein when the bellows tube is hung on a neck of a listener, one end of each of the first bass reflex duct and the second bass reflex duct is positioned below an ear of the listener.

5. The wearable speaker system according to claim 4, further comprising:

a cushioning member or a neckband between the bellows tube and a body of the listener.

6. The wearable speaker system according to claim 1, wherein when the bellows tube is hung on a neck of a listener, the first speaker unit and the second speaker unit are positioned on an upper chest of the listener.

* * * * *